United States Patent [19]

Meinass

[11] 4,102,503

[45] Jul. 25, 1978

[54] METHOD OF AND APPARATUS FOR THE LOW-TEMPERATURE MILLING OF MATERIALS

[75] Inventor: Helmut Meinass, Wolfratshausen, Germany

[73] Assignee: Linde Aktiengesellschaft, Wiesbaden, Germany

[21] Appl. No.: 813,411

[22] Filed: Jul. 6, 1977

Related U.S. Application Data

[63] Continuation of Ser. No. 676,666, Apr. 14, 1976, abandoned.

[30] Foreign Application Priority Data

Apr. 16, 1975 [DE] Fed. Rep. of Germany ..... 2516764

[51] Int. Cl.[2] ..... B02C 23/06

[52] U.S. Cl. ..... 241/18; 241/23; 241/DIG. 37

[58] Field of Search ..... 241/17, 18, 23, 65, 241/DIG. 37

[56] References Cited

U.S. PATENT DOCUMENTS

| | | | |
|---|---|---|---|
| 3,633,830 | 1/1972 | Oberpriller | 241/18 |
| 3,818,976 | 6/1974 | Ledergerber | 241/DIG. 37 |
| 3,897,010 | 7/1975 | Weishaupt et al. | 241/5 |
| 3,921,917 | 11/1975 | Meinass | 241/DIG. 37 |

*Primary Examiner*—Granville Y. Custer, Jr.
*Attorney, Agent, or Firm*—Karl F. Ross

[57] ABSTRACT

Low temperature embrittlement of materials which otherwise cannot be readily comminuted is carried out by treating the materials, e.g. scraps of synthetic resin containing components which might otherwise be released into the atmosphere, with a circulated cooling gas to cause the embrittlement of the materials. The latter are then conveyed through a mill, e.g. a pin-type attrition mill, in a carrier gas and are comminuted therein. The cooling gas is passed continuously around a closed circulation path so that any released components remain trapped in the circulated gas which, in turn, is cooled to a sufficiently low temperature by a separately displaced cooling fluid passed in indirect heat exchanging relationship with the cooling gas stream along the closed path of the latter.

7 Claims, 1 Drawing Figure

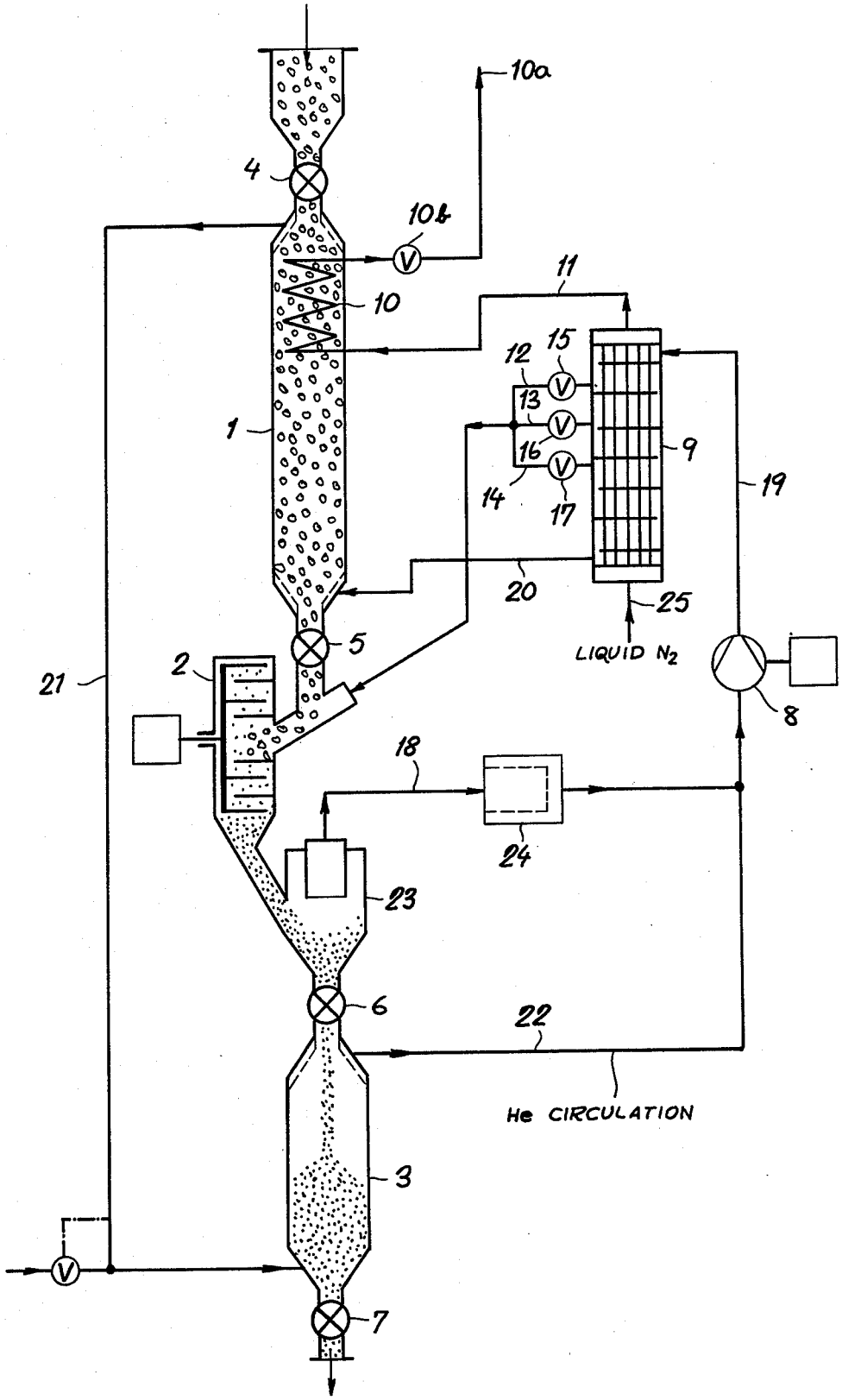
10a
4
10b
V
11
10
12
15
13
V
V
16
V
9
1
14
17
19
20
25
LIQUID $N_2$
5
2
21
8
18
24
23
6
22
He CIRCULATION
3
V
7

METHOD OF AND APPARATUS FOR THE LOW-TEMPERATURE MILLING OF MATERIALS

This application is a continuation of Ser. No. 676,666 filed Apr. 14, 1976 and now abandoned.

FIELD OF THE INVENTION

The present invention relates to a process and an apparatus for the comminution of a material, e.g. plastic scraps, which is to be milled after embrittlement. More particularly, the invention relates to the cold milling of the material after it has been embrittled by chilling it in direct heat exchange with a cooling gas stream and is carried into the mill and through the mill by a carrier gas.

BACKGROUND OF THE INVENTION

German Pat. No. 1,778,559 (U.S. Pat. No. 3,633,830) describes a process for the comminution of materials which are relatively soft, stretchable, plastic or thermoplastic at normal temperatures and hence tend to be stretched upon milling at such temperatures. Such materials include thermoplastic foil scraps and the like. In this process the material to be comminuted is subjected to embrittlement by direct heat exchange with a cold gas stream and, after embrittlement, is conveyed through the mill by a carrier gas stream.

The cooling gas stream and the conveyor gas stream can be the same gas, e.g. gas derived from liquified nitrogen, the latter being mixed with one or both of the gas streams or with the common gas stream, the excess being discharged from the apparatus after heat exchange with the comminuted material.

Especially in the case of synthetic-resin scraps, the material to be comminuted and the comminuted material can contain easily volatilized substances, e.g. plasticizers, which cannot be safely released into the atmosphere even in the smallest quantities. The conventional process thus has significant disadvantages. For example, if release of such easily volatilized substances is to be avoided and a portion of the gas serving as the carrier or cooling gas is released into the atmosphere, it is necessary to provide additional devices, such as filters, adsorbers or the like, to recover the easily volatilized substances. In practice it is found that the latter substances are only partly removed by such techniques.

Another disadvantage of the conventional process, especially when liquefied nitrogen is used as the cooling source, is that the nitrogen carrier gas present in the mill has a relatively high density and, because the mill operates at high speed, considerable energy loss is encountered as a result of gas friction.

OBJECTS OF THE INVENTION

It is the principal object of the present invention to provide a cold milling process whereby the aforementioned disadvantages are avoided.

It is another object of the invention to provide a process for the low-temperature or cryogenic milling of substances which contain readily volatilizable materials not desirable for release into the atmosphere, which avoids such release in a low-cost and efficient manner.

It is still another object of the invention to provide a process for the purposes described in which energy losses are minimized and which is of greater economy than the prior-art processes.

Yet another object of the invention is to provide an apparatus for carrying out the improved process.

SUMMARY OF THE INVENTION

These objects and others which will become apparent hereinafter are attained, in accordance with the present invention, by circulating the cooling gas in a closed path as a circulated gas stream and cooling this gas, before it is brought into direct heat exchange with the material or substance to be milled, by indirect heat exchange with a separately displaced coolant. Advantageously the coolant has a composition different from that of the cooling gas.

More particularly, the process for comminuting cold-embrittlable material comprises the steps of:

(a) chilling the material to a temperature sufficiently low to embrittle it by passing the material in direct heat exchange with a cooling gas;
(b) entraining the chilled material through a mill in a carrier gas in which the chilled material is milled and the milled product is conveyed out of the mill;
(c) continuously circulating the cooling and carrier gas in a gas stream over a closed path; and
(d) cooling this gas stream to a temperature of at most the temperature of embrittlement in step (a) by passing the gas stream at a location along its closed path in indirect heat exchange with a separately displaced coolant fluid.

Thus the cooling gas is continuously recirculated along its closed recirculation path so that any components of the material to be comminuted which are volatilized in and mixed with the cooling gas remain in the closed path and are never released into the atmosphere.

According to an important feature of the invention, the carrier gas stream is advantageously circulated along a closed path and is brought into heat exchange with a separately displaced coolant to reduce the temperature of this carrier gas stream.

Thus the material to be milled and the material being milled are continuously surrounded by an atmosphere of gas fully separated from the ambient atmosphere and displaced along a closed circulating path independently from the coolant which abstracts heat from the gas streams in direct contact with the milled material and the material to be milled.

Advantageously, the cooling and/or carrier gas is constituted by a gas which is lighter (lower in specific gravity or density) than the coolant. Thus the carrier gas can be relatively expensive helium or a gas with a similarly low density which is never lost from the circulating system because it is never released into the atmosphere. Because of the low specific gravity or density of the gas in direct contact with the milled material or the material to be milled, the losses of energy by gas friction are held to a minimum and, especially with mills operating at high speed, the milling efficiency is significantly increased. It is thus possible to operate with mills which otherwise would generate large amounts of gas friction, e.g. pin or attrition mills having rotary disks carrying the attrition pins.

Even with jet mills it is possible to attain a high comminution efficiency since the jet velocity is a function of the speed of sound in the gas present in the mill which, in turn, increases inversely with the molecular weight of the gas. Thus, because of the low molecular weight of a gas such as He, as contrasted with $N_2$ as used heretofore, the jet velocity can be increased and the milling made more efficient.

Furthermore, because of the substantially higher thermal conductivity of low-density gases such as He, as contrasted with, for example, $N_2$, the temperature increase resulting from milling is rapidly conducted away so that the degassing of substances or materials containing readily volatile components is markedly reduced or eliminated.

Since the coolant does not directly contact the materials and can be released into the atmosphere, it can be constituted by a relatively inexpensive fluid serving as the energy carrier, e.g. liquefied $N_2$ which can be brought into indirect heat exchange with the cooling gas stream by a heat exchanger in which the liquefied $N_2$ is evaporated. As noted, this coolant does not come into direct contact with the material to be milled or the milled material and hence the physical or chemical relationship of the coolant to the milled material is of no significance in the process according to the present invention. It is thus unnecessary to provide any after-treating devices, such as absorbers, filters or the like, for any of the coolant which may be released into the atmosphere.

According to a further feature of the invention, the coolant is passed in indirect heat exchange with the material to be milled in order to bring about a precooling of the latter.

It has been found, quite surprisingly, that the consumption of the energy carrier, i.e. the low-cost coolant, and hence the energy consumption of the system of the present invention is lower than that of conventional processes. This can be attributed at least in part to the reduced friction losses and the fact that the system of the present invention permits more exact temperature control, brings about higher efficiency of heat transfer to the material to be milled and from the material which has been milled, and also allows the temperature to be maintained constant more readily in spite of changes in the throughput of the milling system.

It has been found to be advantageous, with respect to the energy consumption and indeed to improve the energy economies of the system, to pass the cooling gas stream in counterflow to the material to be milled and subsequently in counterflow to the milled material.

The system has been found to be especially economical and convenient when, in accordance with the rate of flow in the materials to be comminuted and the temperatures most suitable therefor, the throughput of the cooling gas stream and/or the carrier gas stream is adjustable, e.g. by appropriate valves in the path of these fluids.

For carrying out the process of the present invention, it has been found to be most advantageous to provide an apparatus which comprises a cooling tower, a comminuting device (e.g. a jet or attrition mill) connected to the tower, a collecting vessel or bin for the comminuted material, and gas-tight material gates between the aforementioned components. A compressor is provided to circulate the cooling gas stream and/or the carrier gas stream, and a counterflow heat exchanger is provided along the circulating path for traversal by the circulated gases and by the aforementioned separately displaced coolant.

For precooling of the material to be comminuted in the cooling tower, the latter can be provided with a heat exchanger, e.g. a coil, which is traversed by the coolant connected via a duct with the counterflow heat exchanger which, in turn, can be connected to a source of the coolant, e.g. a source of liquid $N_2$.

For control of the temperatue of the material to be comminuted and the throughflow of the cooling gas stream and/or the carrier gas stream, the counterflow heat exchanger is provided with a set of cooling-gas conduits having adjustable valves connecting the counterflow heat exchanger with the inlet of the comminuting device, at least one further duct being connected to the outlet of the comminuting device for carrying off the gas therefrom.

For the reheating to ambient temperature of the material which has been comminuted and recovering the cold which is stored in the comminuted product as enthalpy of cooling, the counterflow heat exchanger is connected with the cooling column via a duct. A further duct connecting the cooling column with the collecting vessel so that a portion of the circulated gas stream at least is passed in direct heat exchange with the milled product in the latter, and a duct connects the heat exchanger with this collecting vessel.

BRIEF DESCRIPTION OF THE DRAWING

The above and other objects, features and advantages of the present invention will become more readily apparent from the following description, reference being made to the accompanying drawing in which the sole FIGURE is a diagrammatic view of an apparatus for carrying out the process of the present invention.

SPECIFIC DESCRIPTION

The cold-milling apparatus of the present invention comprises a cooling tower 1 closed on opposite ends by gas-tight material-passing gates 4, 5, in which the mterial to be milled is cooled. A pin-type attrition mill 2 is provided below the tower and is connected by another gate 6 with a collecting vessel or bin 3 for the milled product. This container 3 is closed from the atmosphere by still another gate 7.

To cool the material to be milled, a duct 20, leading from a counterflow heat exchanger 9, carries the cooling gas into the base of the tower 1. The cooling gas is preferably He.

The cooling gas after being warmed in direct heat exchange with the material in the tower 1, is carried off at the top of the tower 1 via a duct 21 opening into the base of the bin 3. The gas is further warmed by abstracting cold from the milled product in this container or bin 3 and is carried from the top of the latter via line 22 to a compressor 8. The compressed gas is delivered via line 19 to the other side of the counterflow heat exchanger 9. The compressor 8, line 19, the counterflow heat exchanger 9, line 20, the tower 1, line 21, the bin 3 and line 22 constitute a closed circulation path for the cooling gas stream.

At several locations along the counterflow heat exchanger 9, communicating with the cooling gas space thereof, are lines 12, 13 and 14 provided with respective controllable valves 15, 16 and 17 for diverting a portion of the cooling gas into an inlet for the attrition mill to serve as the carrier gas. A separating vessel 23 is provided between the mill 2 and the bin 3 from which gas (carrier gas) is withdrawn via line 18 and passed through a filter 24 which removes dust of the milled product. The carrier gas rejoins the cooling gas stream at the inlet to the compressor 8. Thus a closed path for the carrier gas stream is established via line 18, filter 24, compressor 8, line 19, lines 12, 13 or 14, mill 2 and the separating chamber 23.

In the counterflow heat exchanger 9, the cooling gas stream and the carrier gas stream are cooled via a separately displaced coolant fluid delivered via line 25 from a suitable source, e.g. an air rectification installation, tank, liquefaction device or the like. The cooling fluid is liquid $N_2$. Since the coolant does not fully lose its cooling power within the counterflow heat exchanger 9, it is passed in a gaseous stage through a heat exchanger 10, e.g. a coil, within the tower 1 to precool the material therein. The nitrogen is thereafter released into the atmosphere at 10*a* through a valve 10*b*.

I claim:

1. A process for comminuting cold-embrittable material comprising the steps of:

(a) chilling said material to a temperature sufficiently low to embrittle it by passing it in direct heat exchange with a cooling gas;

(b) entraining the chilled material through a mill in a carrier gas which can be of the same composition as said cooling gas and in which said chilled material is milled and the milled product is conveyed out of the mill;

(c) separating said milled product from said carrier gas;

(d) continuously circulating said cooling and carrier gas upon the separation of said material therefrom in a gas stream over a closed path without venting or replenishment, said closed path including a compressor and a heat exchanger downstream of said compressor;

(e) cooling said gas stream to a temperature of at most the temperature of step (a) by passing said gas stream at said heat exchanger in indirect heat exchange with a separately displaced coolant fluid;

(f) passing said coolant fluid after it has traversed said heat exchanger in indirect heat exchange with said material to precool the same; and (g) venting said coolant fluid after it has precooled said material.

2. The process defined in claim 1 wherein said cooling gas is first passed in counterflow to said material in step (a) and is thereafter passed in counterflow to the product separated in step (c).

3. The process defined in claim 1 wherein the throughput of at least one of said cooling and carrier gases is controllable.

4. The process defined in claim 1 wherein at least one of said cooling and carrier gases consists of a gas having a density less than that of said coolant fluid.

5. An apparatus for comminuting cold-embrittable material comprising:

a cooling tower for chilling said material to a temperature sufficiently low to embrittle it by passing it in direct heat exchange with a cooling gas;

a mill connected with said tower for milling the chilled material produced by said tower;

means for entraining the chilled material through said mill in a carrier gas and producing a milled product conveyed out of the mill in said carrier gas;

a collecting bin connected to said mill for accumulating said milled product;

means for continuously circulating said cooling gas in a gas stream through said tower over a closed non-venting path;

a counterflow heat exchanger along said path for passing said cooling gas in indirect heat exchange with a separately displaced coolant fluid;

a compressor upstream of said counterflow heat exchanger along said path for displacing said cooling gas along said path;

a heat exchanger in said tower communicating with and downstream of said counterflow heat exchanger in the path of said coolant fluid to precool said material within said tower; and means for venting said coolant fluid after it has precooled said material within said tower.

6. The apparatus defined in claim 5, further comprising a plurality of ducts each with a respective controllable valve connecting said counterflow heat exchanger with an inlet to said mill to supply a portion of the cooling gas stream from said counterflow heat exchanger to said mill as said carrier gas, the outlet of said mill being connected to a separator for separating the milled product from said carrier gas which is supplied to said counterflow heat exchanger whereby a closed path for said carrier gas is established between said counterflow heat exchanger and said mill.

7. The apparatus defined in claim 5, wherein said path includes duct means connecting said tower with said bin for passing said cooling gas in succession through said tower and said bin.

* * * * *